US011358774B2

(12) United States Patent
Kato

(10) Patent No.: US 11,358,774 B2
(45) Date of Patent: Jun. 14, 2022

(54) SHEET PACKAGE WITH A FIRST SLIT

(71) Applicant: DAIO PAPER CORPORATION, Shikokuchuo (JP)

(72) Inventor: Hirohiko Kato, Fujinomiya (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 0 days.

(21) Appl. No.: 16/977,554

(22) PCT Filed: Nov. 29, 2018

(86) PCT No.: PCT/JP2018/044056
§ 371 (c)(1),
(2) Date: Sep. 2, 2020

(87) PCT Pub. No.: WO2019/187347
PCT Pub. Date: Oct. 3, 2019

(65) Prior Publication Data

US 2021/0002053 A1 Jan. 7, 2021

(30) Foreign Application Priority Data

Mar. 29, 2018 (JP) ..... JP2018-063601

(51) Int. Cl.
*B65D 77/30* (2006.01)
*B65D 85/672* (2006.01)

(52) U.S. Cl.
CPC ..... *B65D 77/30* (2013.01); *B65D 85/672* (2013.01)

(58) Field of Classification Search
CPC ..... B65D 33/00; B65D 33/02; B65D 33/08; B65D 33/10; B65D 77/30; B65D 85/62;
(Continued)

(56) References Cited

U.S. PATENT DOCUMENTS 1,806,273 A * 5/1931 Williams ..... A47K 10/16 206/389
8,220,700 B2 * 7/2012 Myers ..... B65D 75/5833 229/87.05

(Continued)

FOREIGN PATENT DOCUMENTS

JP S5428618 U 2/1979
JP 3060143 U 7/1999

(Continued)

OTHER PUBLICATIONS

Translation of International Search Report dated Jan. 22, 2019 and Written Opinion of corresponding application No. PCT/JP2018/044056; 7 pgs.

(Continued)

*Primary Examiner* — Bryon P Gehman
(74) *Attorney, Agent, or Firm* — Maier & Maier, PLLC

(57) ABSTRACT

This sheet package includes a sheet roll obtained by winding a sheet on a cylindrical core in the circumferential direction thereof; and a packaging bag that stores the sheet roll, wherein at least one end surface, in the roll width direction, of the sheet roll faces the top surface of the packaging bag, the cylindrical core has an opening in which the end edge of the sheet roll on one end surface side is opened, and a first slit is formed on the top surface so as to overlap the opening of the cylindrical core.

6 Claims, 14 Drawing Sheets

(58) Field of Classification Search
CPC .... B65D 85/67; B65D 85/671; B65D 85/672; B65D 75/62; B65D 85/00; B65D 85/02
USPC ..... 206/391, 394, 494
See application file for complete search history.

(56) References Cited

U.S. PATENT DOCUMENTS

| | | | | |
|---|---|---|---|---|
| 8,256,616 | B2 * | 9/2012 | Eilert | B65D 75/5827 206/391 |
| 9,708,085 | B2 * | 7/2017 | Moore | B65D 85/07 |
| 9,821,923 | B2 * | 11/2017 | Moore | B65B 13/02 |

FOREIGN PATENT DOCUMENTS

| | | | | | |
|---|---|---|---|---|---|
| JP | 2000302166 | A | | 10/2000 | |
| JP | 2002-120864 | A | | 4/2002 | |
| JP | 2003-104449 | A | | 4/2003 | |
| JP | 2004-269009 | A | | 9/2004 | |
| JP | 2009-035323 | A | | 2/2009 | |
| JP | 2011189965 | A | | 9/2011 | |
| JP | 201554700 | A | * | 3/2015 | B65D 85/671 |
| WO | 2012/061263 | A2 | | 5/2012 | |

OTHER PUBLICATIONS

Extended European Search Report dated Apr. 21, 2021 of corresponding application No. 18912504; 7 pgs.

Chinese Office Action dated Sep. 3, 2021, in connection with corresponding CN Application No. 201880090651.0 (12 pp., including machine-generated English translation).

Japanese Office Action dated Sep. 28, 2021, in connection with corresponding JP Application No. 2019-056994 (7 pp., including machine-generated English translation).

Office Action dated Apr. 19, 2022 in corresponding Chinese Application No. 201880090651.0; 12 pages including English-language translation.

* cited by examiner

[FIG. 1]
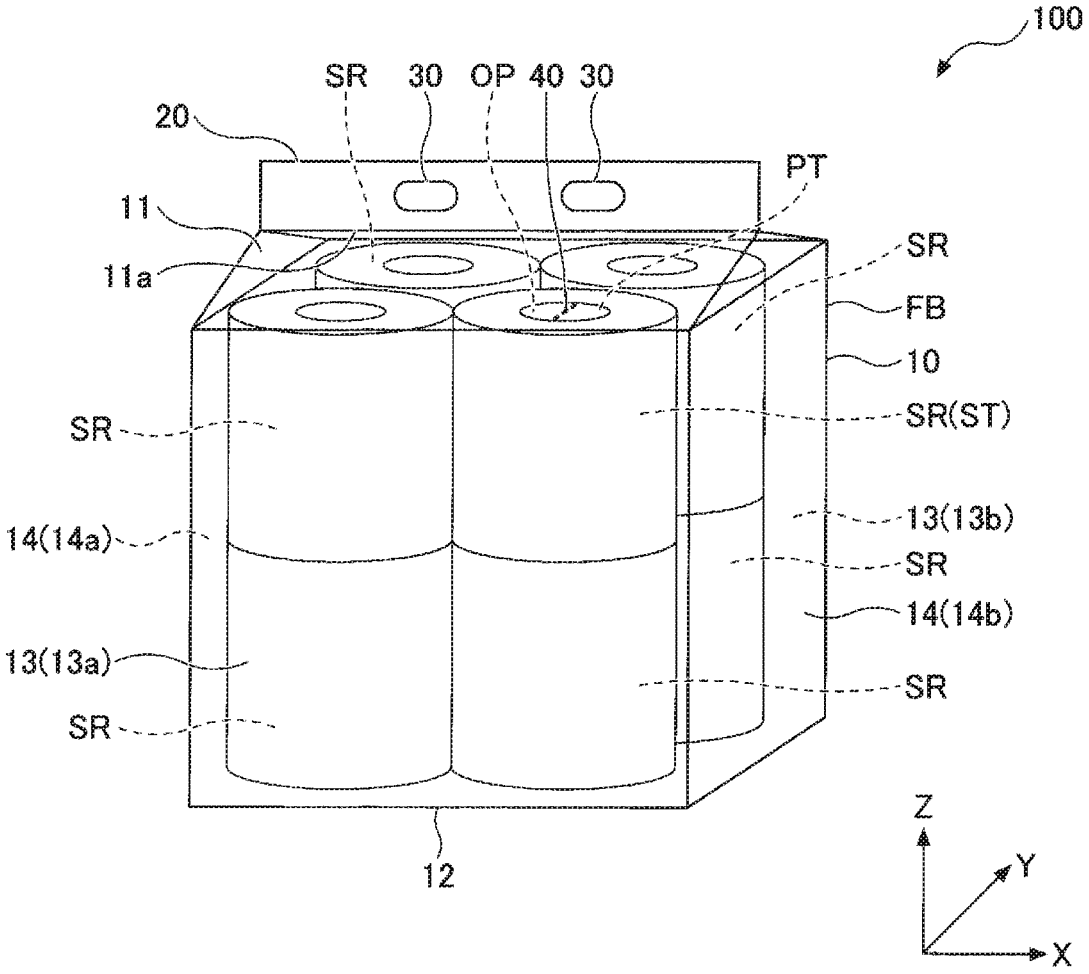
[FIG. 2]
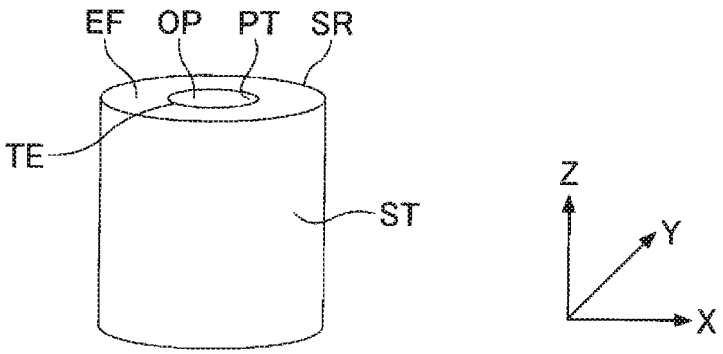

[FIG. 3]
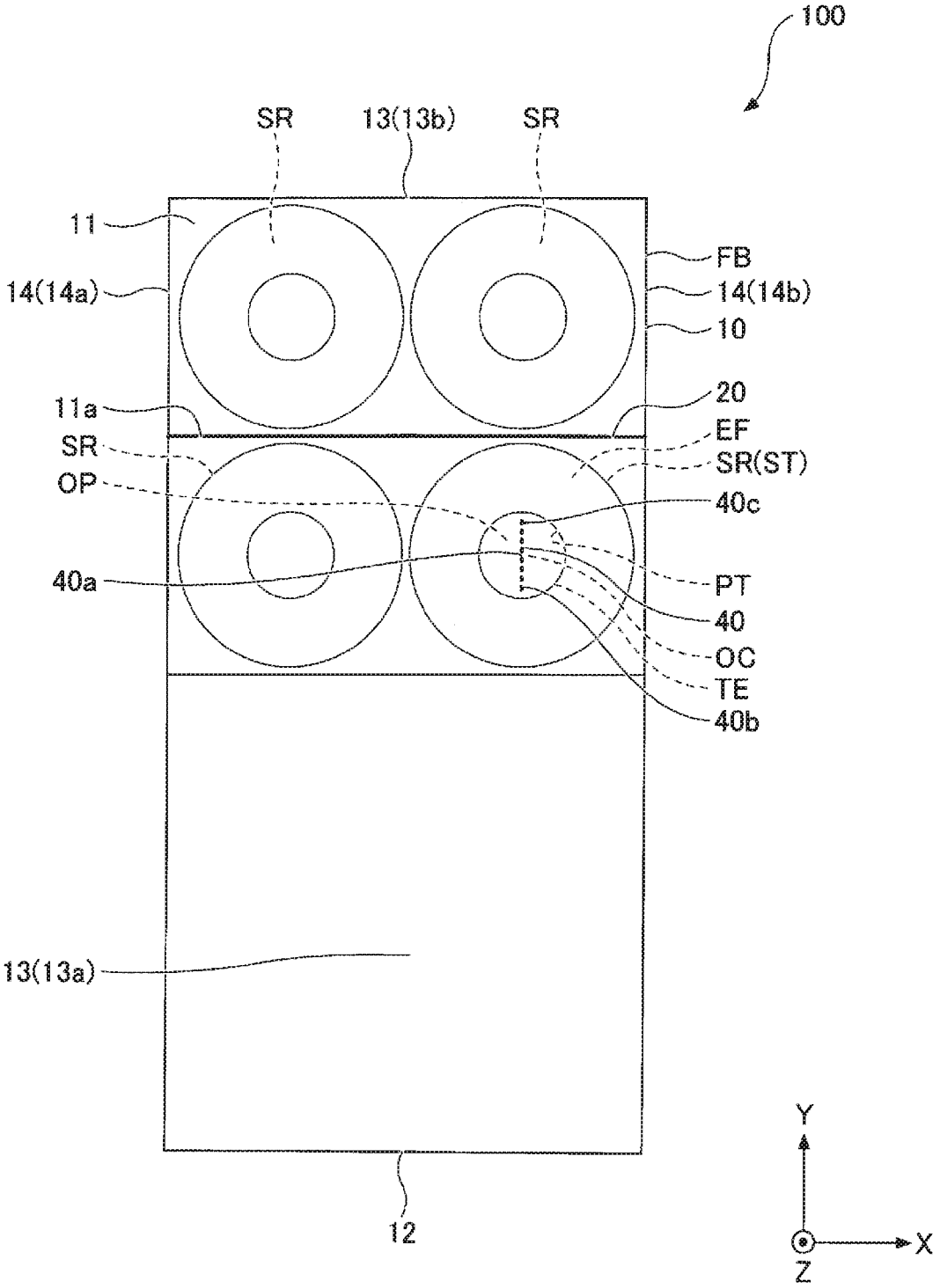

[FIG. 4]
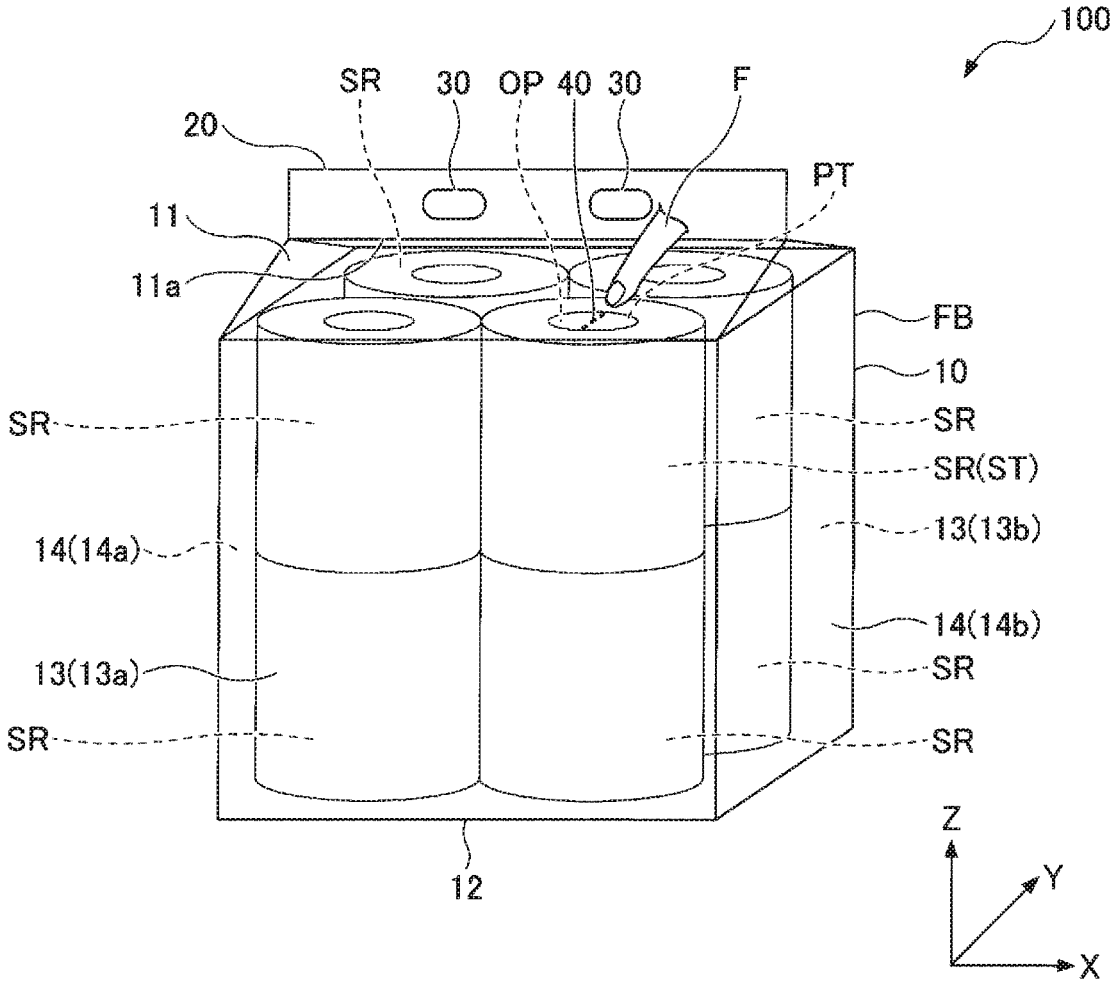

[FIG. 5]
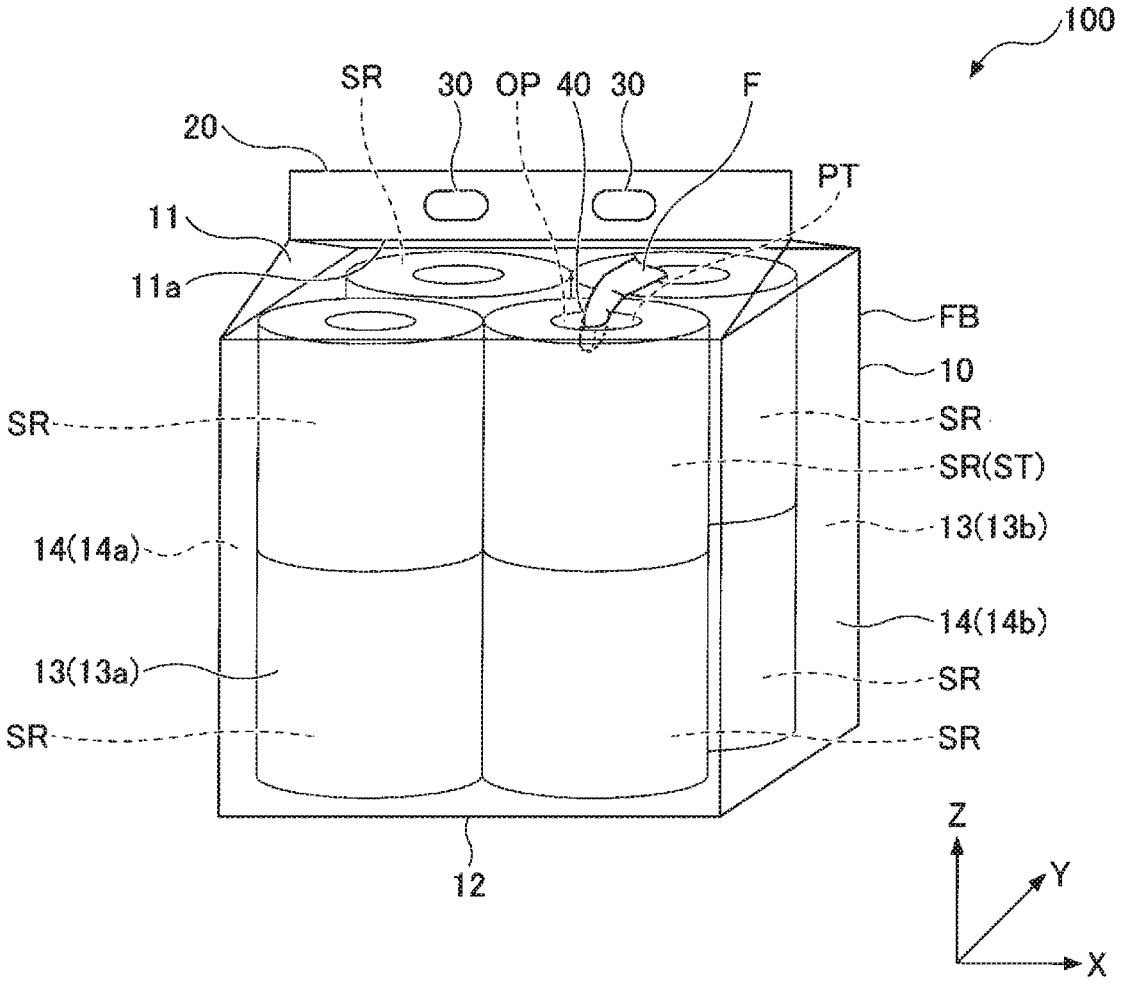

[FIG. 6]
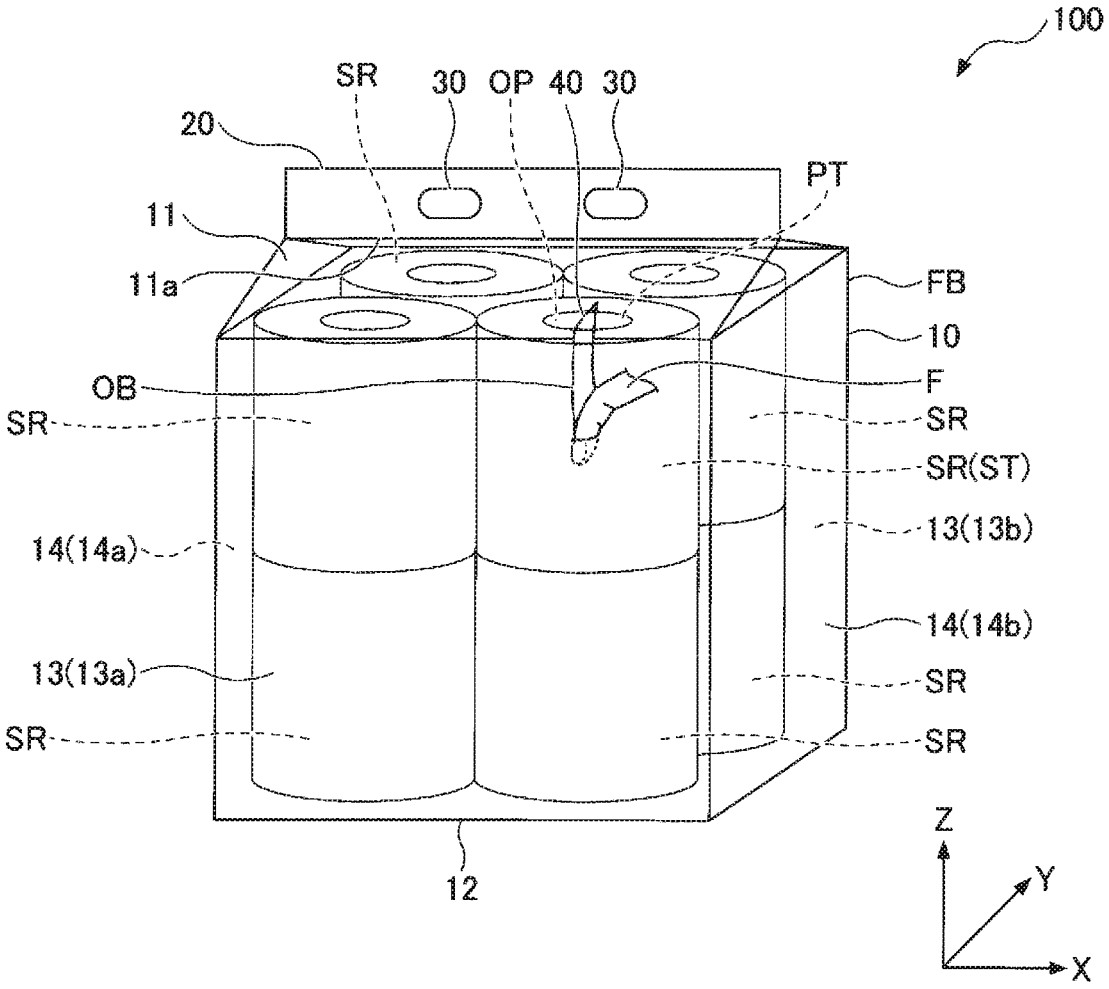

[FIG. 7]
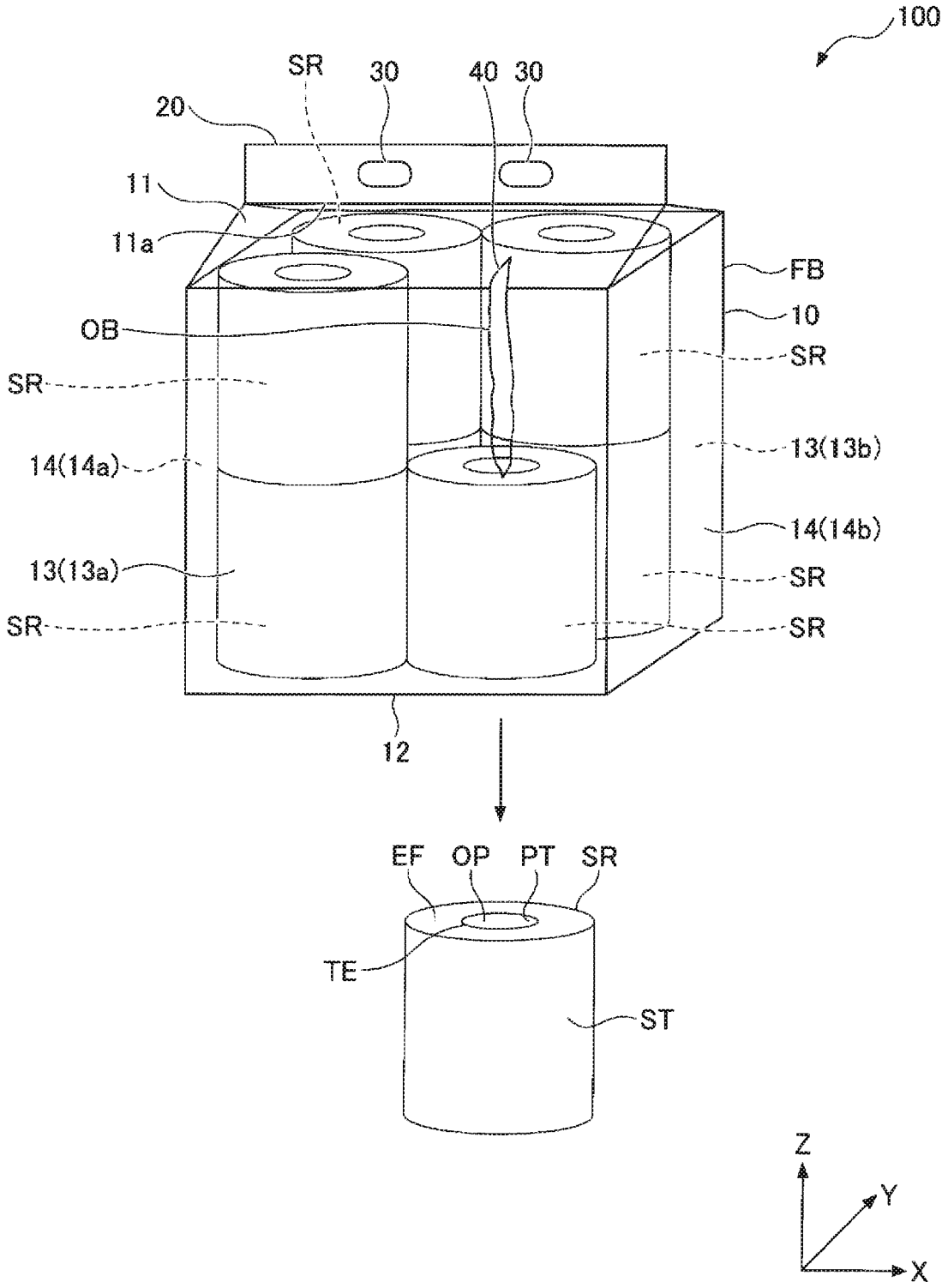

[FIG. 8]
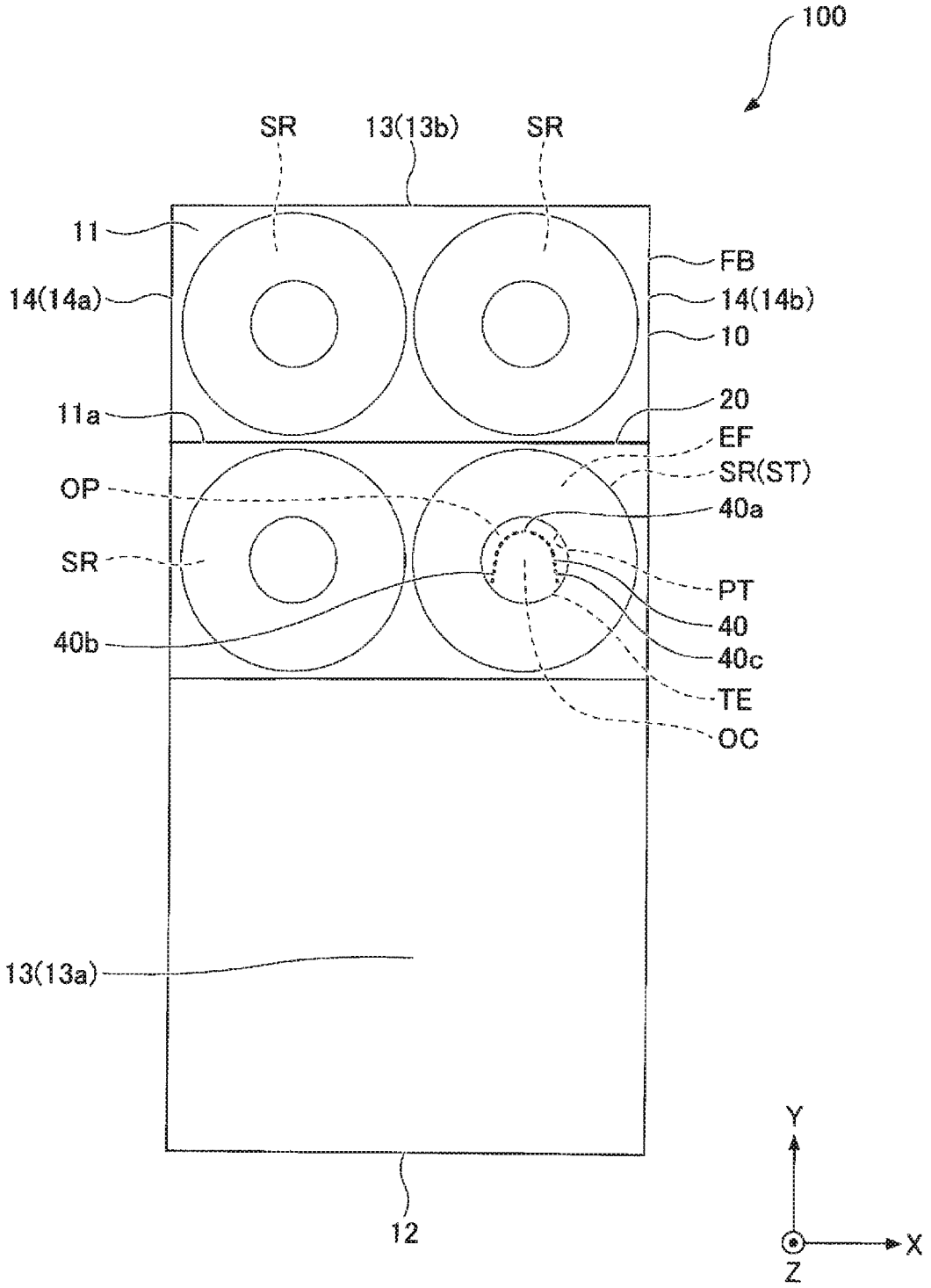

[FIG. 9]
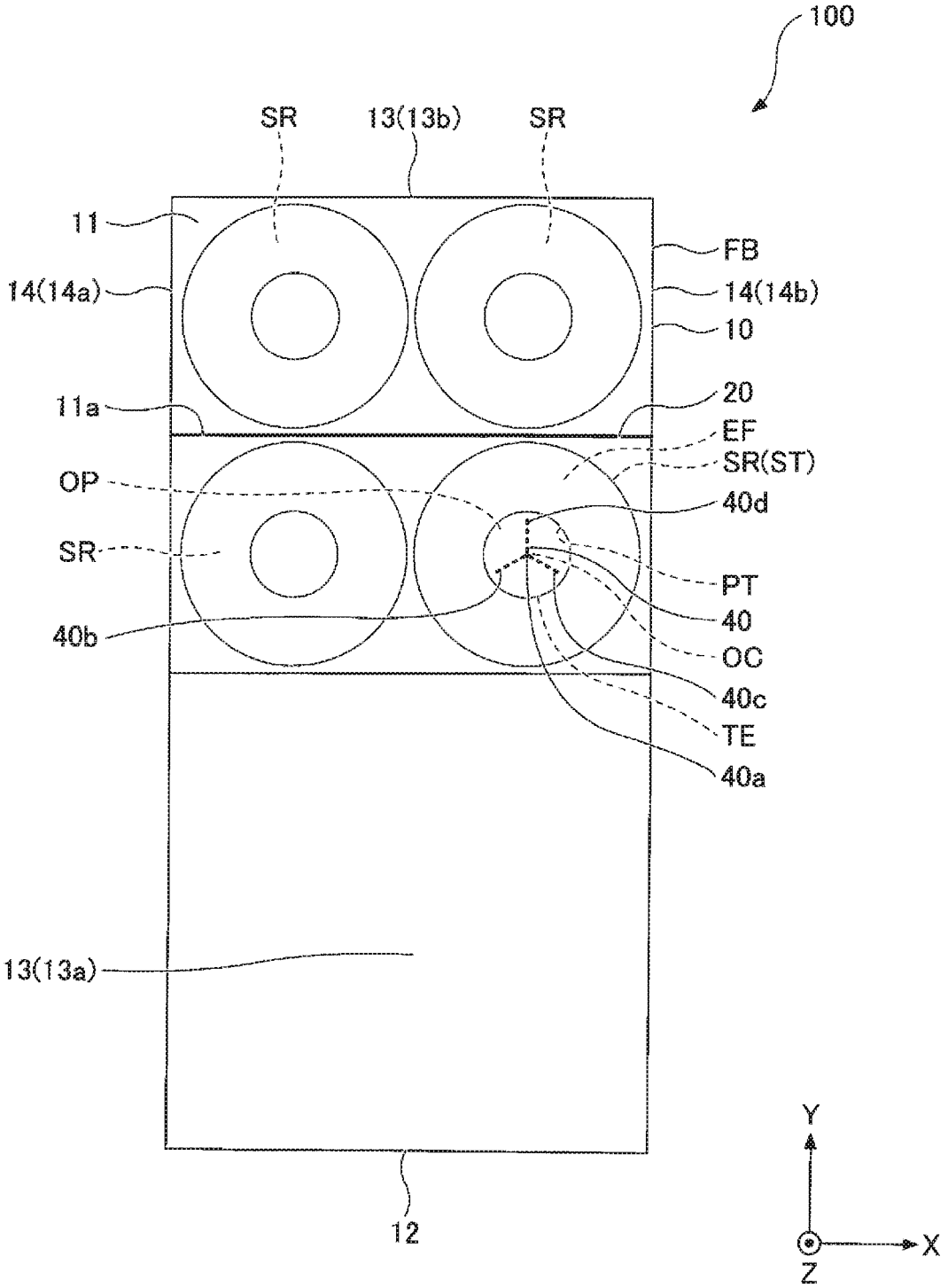

[FIG. 10]
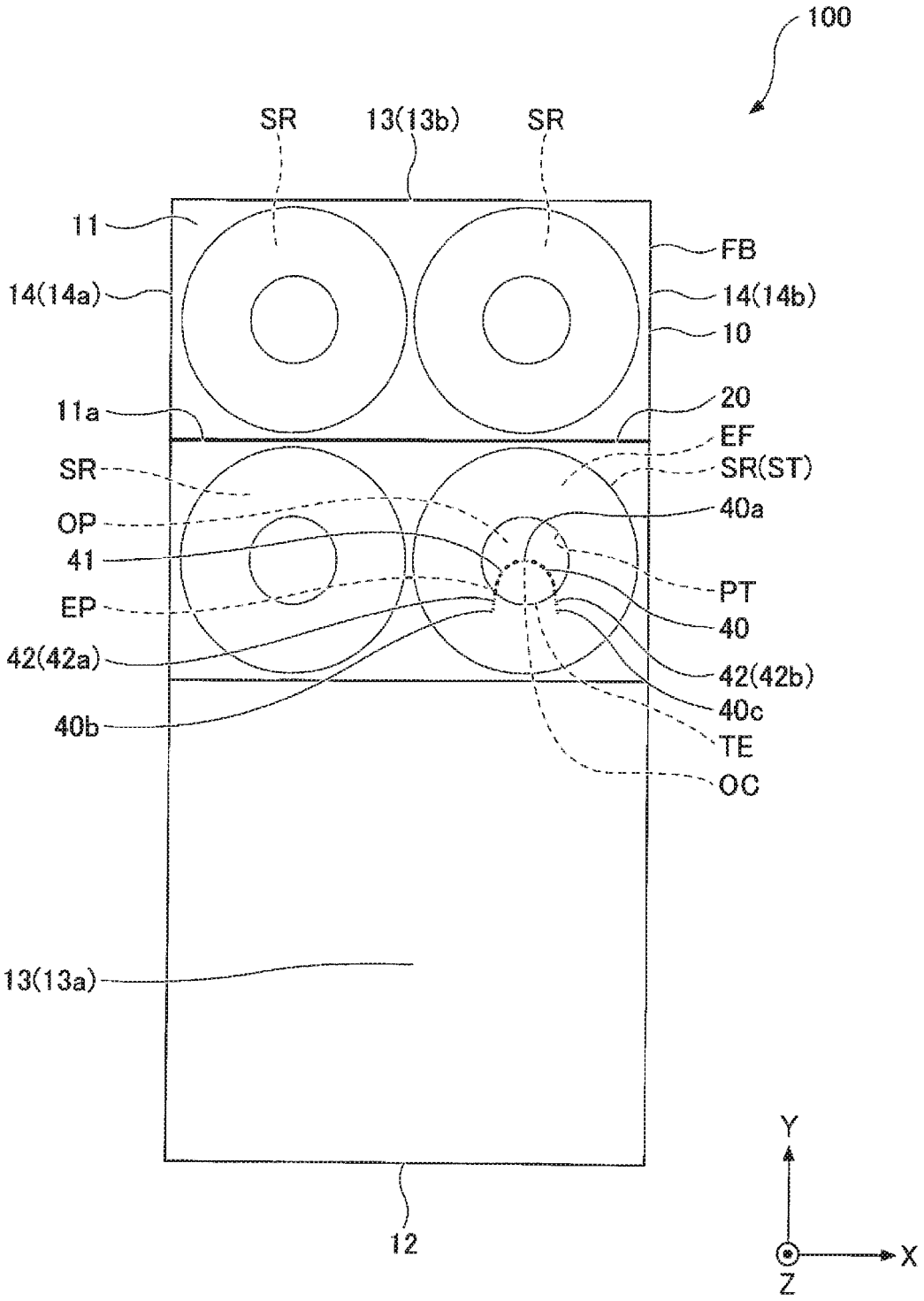

[FIG. 11]
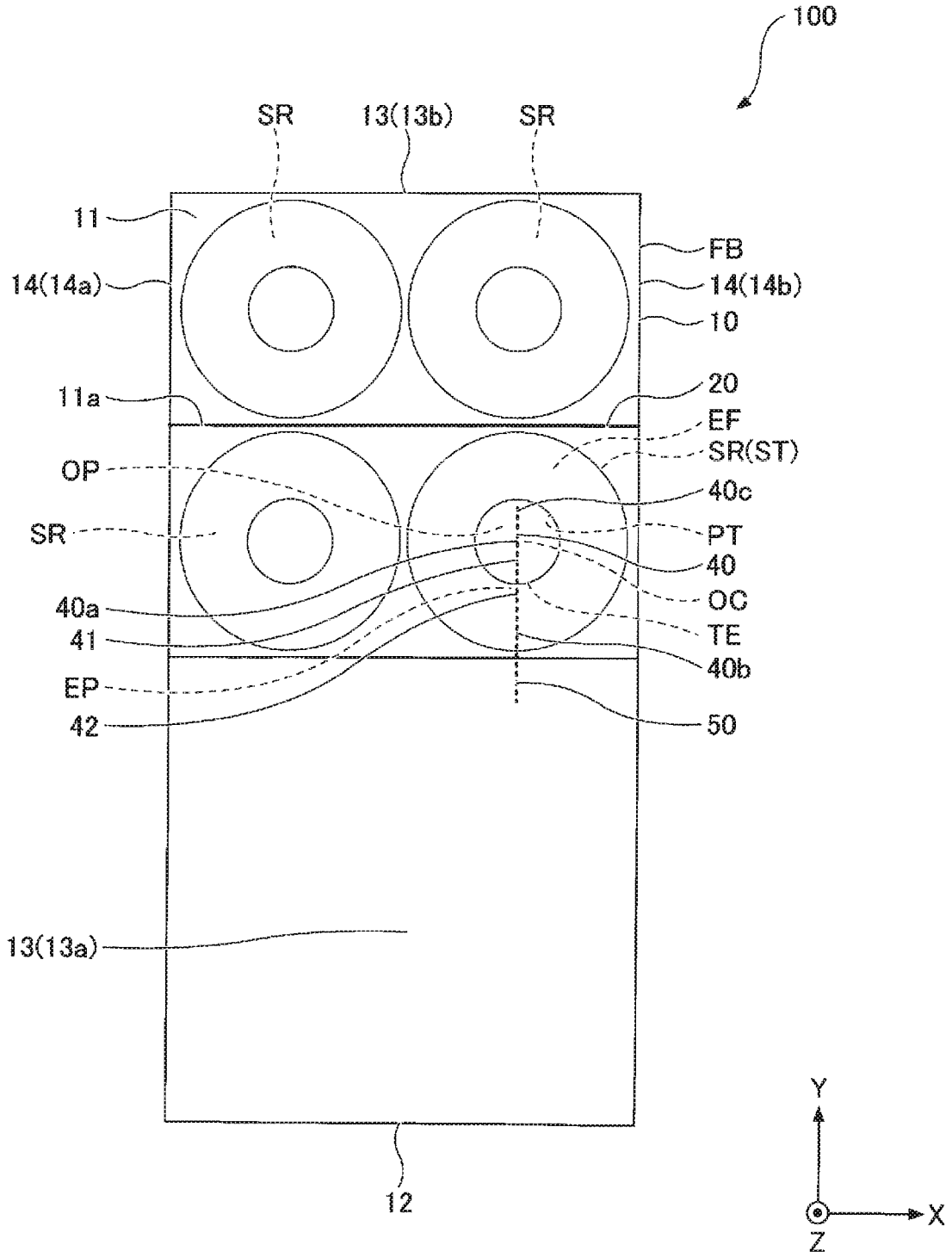

[FIG. 12]
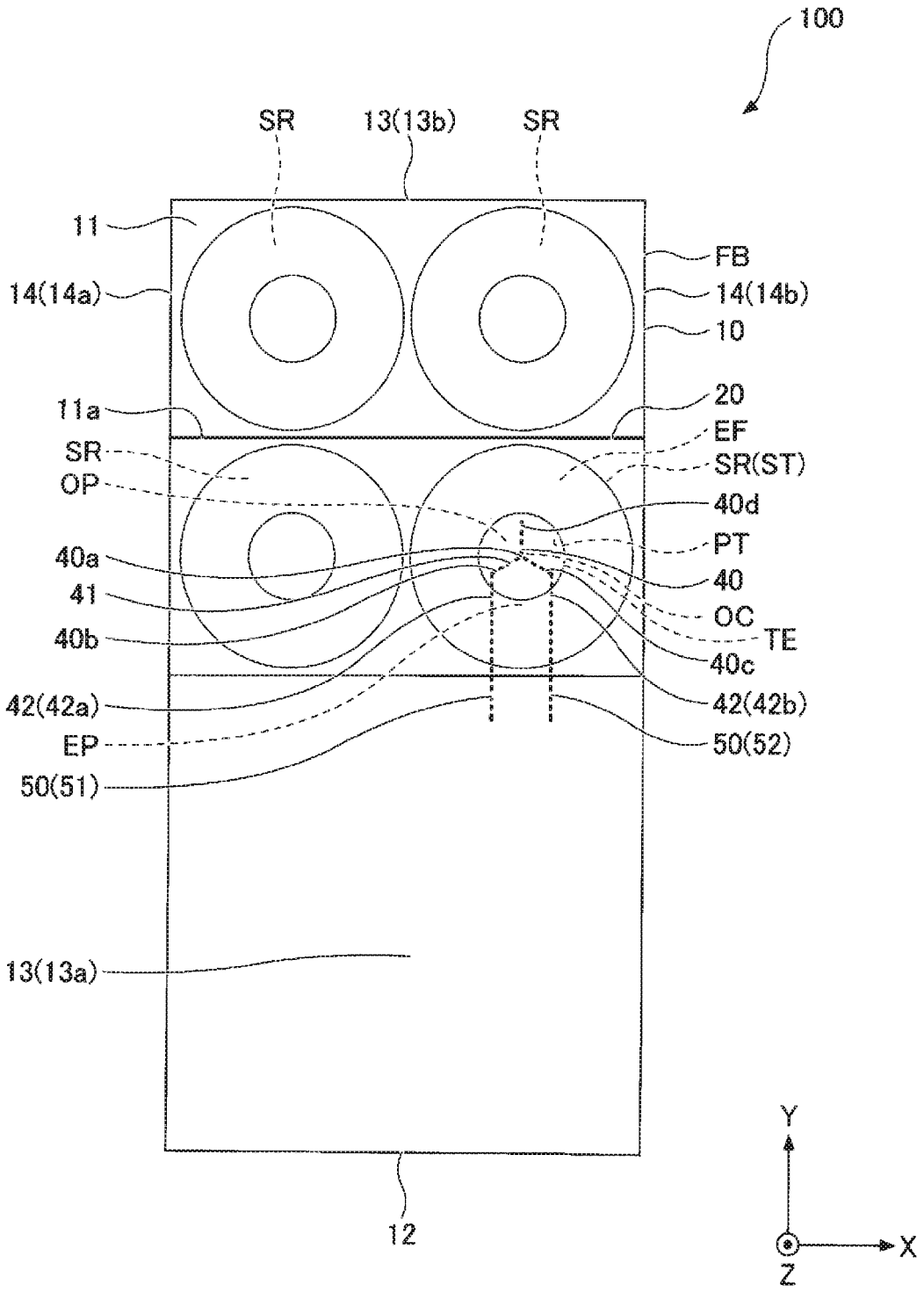

[FIG. 13]
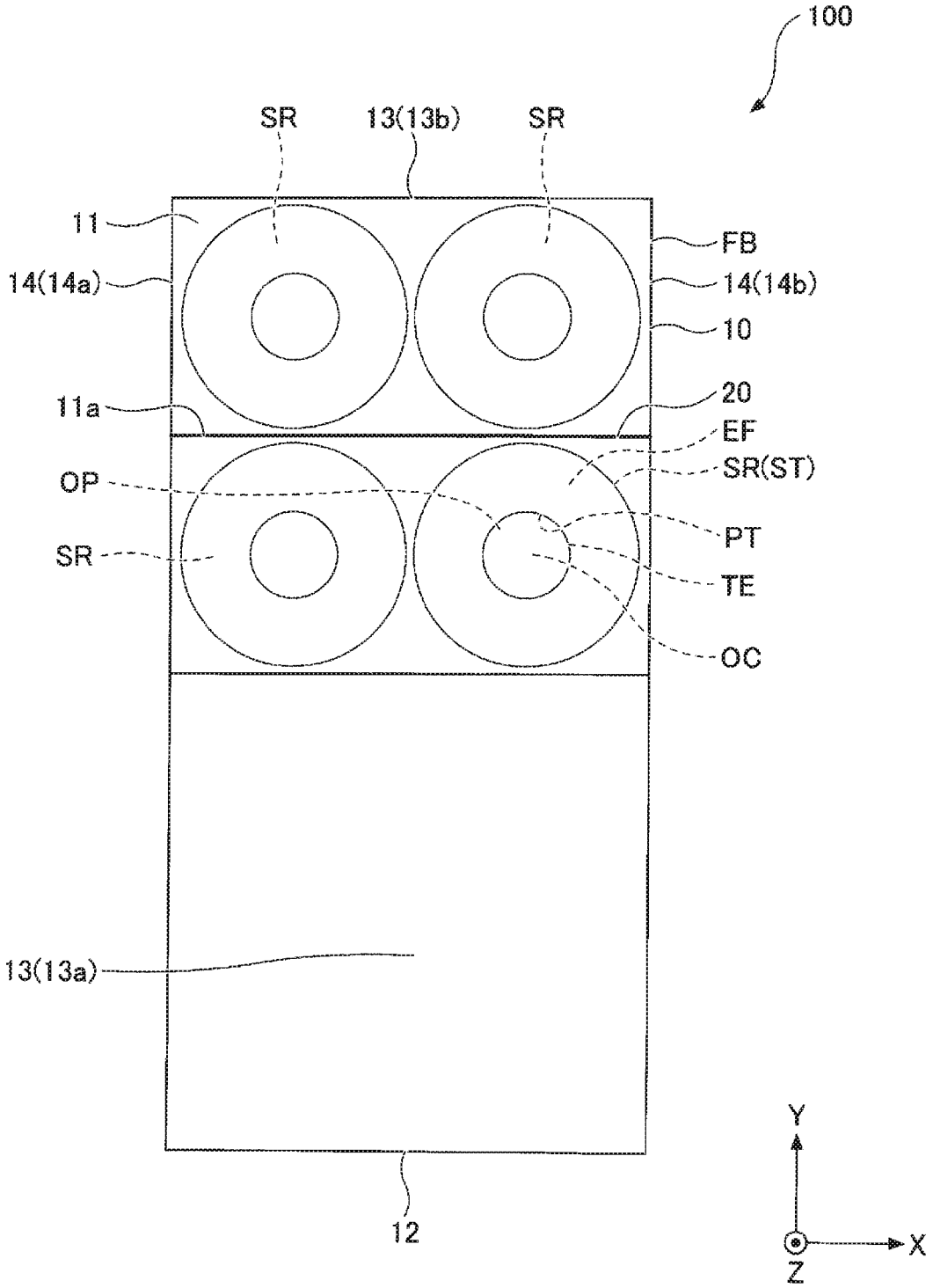

[FIG. 14]
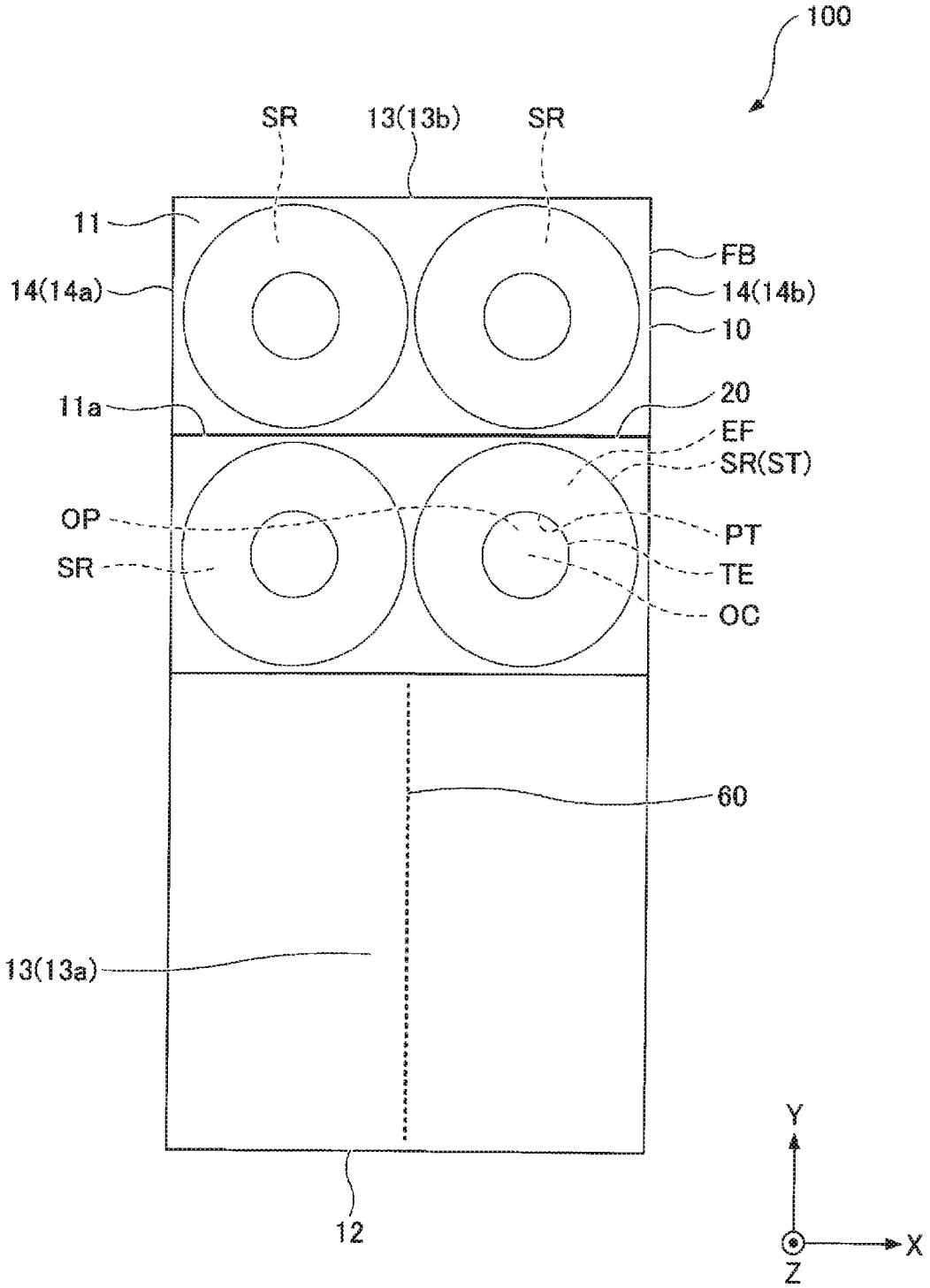

[FIG. 15]
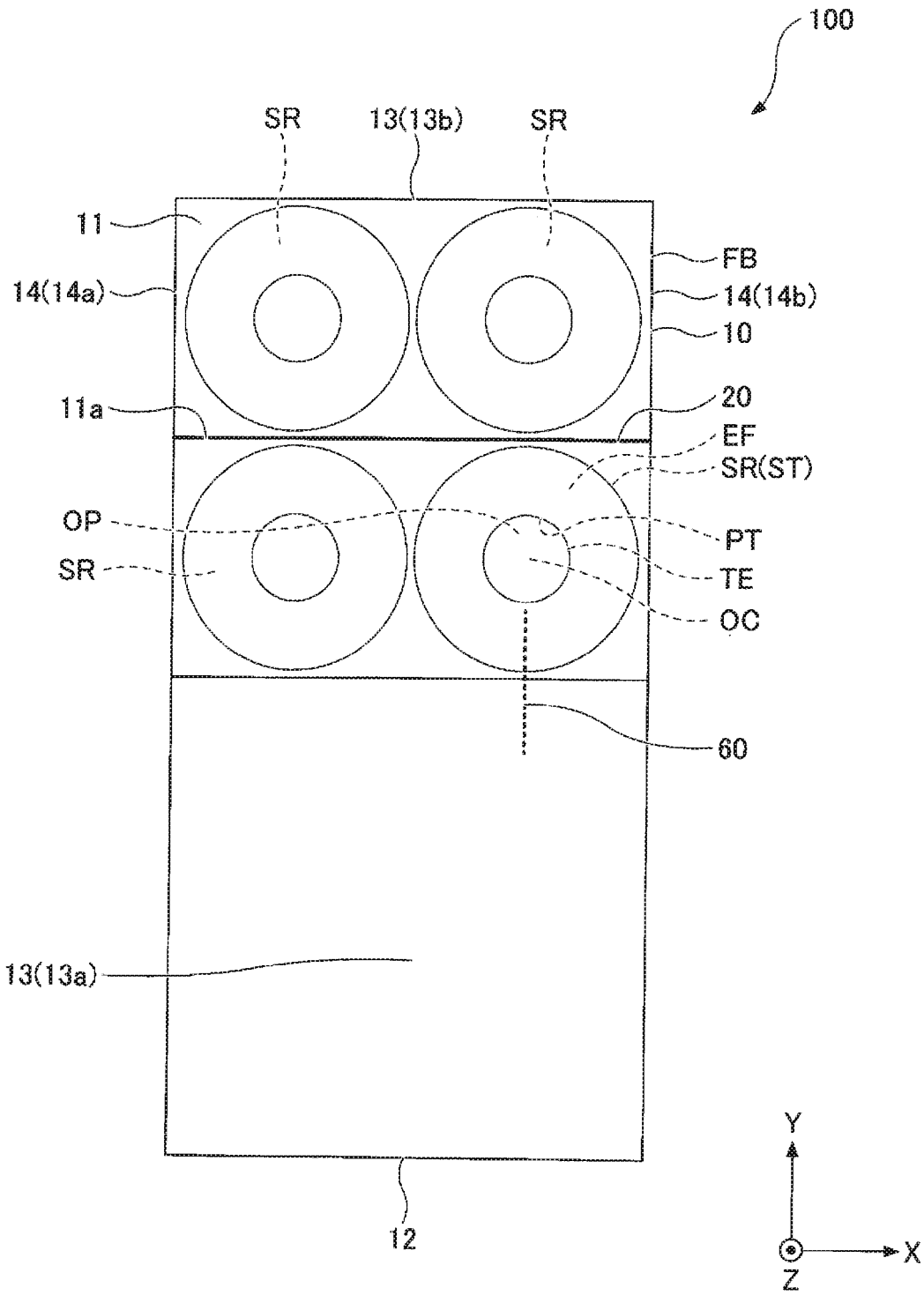

SHEET PACKAGE WITH A FIRST SLIT

FIELD

The present invention relates to a sheet package.

BACKGROUND

In a conventional sheet package, sanitary thin paper such as toilet paper or kitchen paper is stored in a packaging bag formed of a resin film, etc. in a rolled state. In recent years, there is a tendency that daily necessities which can be used for a long period of time and have a high accommodating property and stocking property are favored due to changes in lifestyles of consumers, and a lot of long length products in which a roll length of a roll is increased have been developed for sanitary thin paper stored in the sheet package.

For example, in a long length kitchen roll, it takes a certain amount of time to use up one kitchen roll. Further, the kitchen roll is frequently used when handling foodstuffs, and thus there is a need for a packaging bag that can hygienically store the kitchen roll. In addition, when the packaging bag storing the sanitary thin paper is torn, the packaging bag may not be neatly torn in many cases, and it is required that the packaging bag included in the sheet package be easy to open.

For example, JP-A-2003-104449 (Patent Document 1) discloses a package for packaging roll-shaped kitchen paper. In this package, a perforation for opening is provided in a vertical direction on a front surface of a packaging bag.

Patent Document 1: JP-A-2003-104449

SUMMARY

However, in the conventional sheet package, a user may forcibly open the sheet package from a place where the perforation is not provided without knowing a place where the perforation is provided or how to open the sheet package. For this reason, a strong force is required to open the sheet package, which is difficult for some users. In addition, since an opening location and a state after opening differ depending on the user, it may be difficult to take out a product from the packaging bag after opening. Furthermore, even in the case of opening along a perforation for opening, the packaging bag of the sheet package and a handle portion tend to be torn over a wide range, and the remaining product may not be stored cleanly in the packaging bag of the sheet package after opening in some cases.

An object of the invention is to provide a sheet package excellent in openability, a take-out property, and storability after opening.

An aspect of the invention provides a sheet package including a sheet roll in which a sheet is wound in a circumferential direction of a cylindrical core, and a packaging bag in which the sheet roll is stored, in which at least one end surface of the sheet roll in a roll width direction faces a top surface of the packaging bag, the cylindrical core has an opening in which an end edge of the sheet roll on a side of the one end surface is open, and a first slit overlapping the opening of the cylindrical core is formed on the top surface.

According to an aspect of the invention, it is possible to provide a packaging bag excellent in openability, a take-out property, and storability after opening.

BRIEF DESCRIPTION OF THE DRAWINGS

FIG. 1 is a diagram illustrating a sheet package according to an embodiment (first embodiment) of the invention.

FIG. 2 is a diagram illustrating an example of a sheet roll stored in a packaging bag in the sheet package according to the first embodiment.

FIG. 3 is a diagram in which a side surface of the packaging bag is unfolded so as to be flush with a top surface of the packaging bag in the sheet package according to the first embodiment.

FIG. 4 is a diagram illustrating a usage state (before opening) of the sheet package according to the first embodiment.

FIG. 5 is a diagram illustrating a usage state (during opening) of the sheet package according to the first embodiment.

FIG. 6 is a diagram illustrating a usage state (during opening) of the sheet package according to the first embodiment.

FIG. 7 is a diagram illustrating a usage state (after opening) of the sheet package according to the first embodiment.

FIG. 8 is a diagram in which a side surface of a packaging bag is unfolded so as to be flush with a top surface of the packaging bag in a sheet package according to a second embodiment.

FIG. 9 is a diagram in which a side surface of a packaging bag is unfolded so as to be flush with a top surface of the packaging bag in a sheet package according to a third embodiment.

FIG. 10 is a diagram in which a side surface of a packaging bag is unfolded so as to be flush with a top surface of the packaging bag in a sheet package according to a fourth embodiment.

FIG. 11 is a diagram in which a side surface of a packaging bag is unfolded so as to be flush with a top surface of the packaging bag in a sheet package according to a fifth embodiment.

FIG. 12 is a diagram in which a side surface of a packaging bag is unfolded so as to be flush with a top surface of the packaging bag in a sheet package according to a sixth embodiment.

FIG. 13 is a diagram in which a side surface of a packaging bag is unfolded so as to be flush with a top surface of the packaging bag in a conventional sheet package (Comparative Example 1).

FIG. 14 is a diagram in which a side surface of a packaging bag is unfolded so as to be flush with a top surface of the packaging bag in a conventional sheet package (Comparative Example 2).

FIG. 15 is a diagram in which a side surface of a packaging bag is unfolded so as to be flush with a top surface of the packaging bag in a conventional sheet package (Reference Example 1).

DETAILED DESCRIPTION

Hereinafter, embodiments of the invention will be described in detail with reference to the drawings. Note that in this specification, to facilitate understanding, the scale of each member in each drawing may differ from the actual scale. Further, in the following description, common parts in each drawing are denoted by the same reference numerals, and description thereof may be omitted.

In this specification, one side in a vertical direction (height direction) of a sheet package may be referred to as "up" or an upper side, and the other side may be referred to as "down" or a lower side. In addition, a three-dimensional orthogonal coordinate system in 3-axis directions (X direction, Y direction, and Z direction) is used. A width direction (left-right direction or lateral direction orthogonal to the vertical direction) of the sheet package is defined as the X direction, a depth direction (direction perpendicular to the left-right direction) of the sheet package is defined as the Y direction, and the height direction (vertical direction) of the sheet package is defined as the Z direction.

FIG. 1 is a diagram illustrating a sheet package 100 according to an embodiment (first embodiment) of the invention. FIG. 2 is a diagram illustrating an example of a sheet roll stored in a packaging bag in the first embodiment of FIG. 1. FIG. 3 is a diagram in which a side surface of the packaging bag is unfolded so as to be flush with a top surface of the packaging bag in the sheet package according to the first embodiment.

In FIG. 1, the sheet package 100 is configured by a sheet roll SR stored (or accommodated) in a packaging bag FB. In addition, the packaging bag FB includes a main body 10, a handle portion 20, and a finger hook 30. The packaging bag FB is manufactured from a resin film, etc. using a bag-making machine. The sheet package 100 is an example of a sheet package of the invention. In addition, the packaging bag FB is an example of a packaging bag that stores a sheet roll in the sheet package according to the invention, and the sheet roll SR is an example of a sheet roll stored in the packaging bag in the sheet package of the invention.

As illustrated in FIGS. 1 and 2, the main body 10 of the packaging bag FB is included in a main body of the sheet package 100 in which a plurality of sheet rolls SR is stored. The main body 10 is made of a tubular film obtained by forming a resin film into a tubular shape, and has a structure in which the tubular film is folded in a gusset shape to form a bag shape (see FIGS. 1 and 3).

A material of the tubular film (resin film) forming the main body 10 is arbitrary. As such a resin film, for example, it is possible to use a resin film such as polyethylene (PE) or a stacked body (PE/EVOH/PE) of PE-ethylene vinyl alcohol copolymer (EVOH)-PE. In addition, a thickness of the resin film is arbitrary. For example, when PE or PE/EVOH/PE is used as the resin film, the thickness of the resin film can be set to 10 to 70 μm, preferably 15 to 60 μm, and more preferably 20 to 50 μm.

The main body 10 of the packaging bag FB has a top surface 11, a bottom surface 12, a pair of first side surfaces 13 (one side surface 13*a* and the other side surface 13*b*), and a pair of second side surfaces 14 (one side surface 14*a* and the other side surface 14*b*).

The top surface 11 is formed on the upper side of the main body 10. The bottom surface 12 is formed on the lower side of the main body 10 and faces the top surface 11 in the Z direction (vertical direction or height direction of the sheet package 100). The pair of first side surfaces 13 is disposed between the top surface 11 and the bottom surface 12 to face each other in the Y direction (depth direction of the sheet package 100). The pair of second side surfaces 14 is disposed between the top surface 11 and the bottom surface 12 to face each other in the X direction (width direction of the sheet package 100 or the left-right direction orthogonal to the vertical direction).

Note that in the sheet package 100, the top surface 11 is an example of a top surface of the packaging bag, the bottom surface 12 is an example of a bottom surface of the packaging bag, and the pair of first side surfaces 13 and/or the pair of second side surfaces 14 is an example of side surfaces of the packaging bag.

As illustrated in FIGS. 1 and 3, the handle portion 20 is provided on the top surface 11 of the main body 10 of the packaging bag FB. The handle portion 20 is included in a portion of the sheet package 100 grabbed (or held) by a hand or a finger (hereinafter referred to as a finger). The handle portion 20 can be formed of a resin film, etc. similarly to the main body 10. The handle portion 20 is integrally formed with the main body 10 on a connection portion 11*a* of the top surface 11 by a seal part (not illustrated) formed by heat sealing (heat seal).

Note that heat sealing (heat seal) for forming the seal part can be performed by, for example, a scheme (stamp scheme) in which the resin film folded in the gusset shape is embossed with a hot plate for forming a handle. In addition, an air hole (not illustrated) connecting the main body 10 and the outside of the sheet package 100 may be provided in the handle portion 20 so that the main body 10 to which the handle portion is attached does not tear during manufacturing or distribution of the sheet package 100.

The handle portion 20 is further provided with the finger hook 30 for hooking the finger when holding the handle portion 20. The finger hook 30 is formed in a center part of the handle portion 20 in the left-right direction (X direction). In addition, the finger hook 30 is formed by two elliptical slits disposed at a predetermined interval in the left-right direction (X direction). The slits may have any form. For example, perforations may be formed, and the finger hooks may be formed by breaking the perforations.

Note that a shape of the finger hook 30 is not limited to an elliptical shape, and may be a linear shape, a curved shape, a circular shape, an oval shape, a rectangular shape, etc. or shapes similar to these shapes. Further, even though the finger hook 30 is formed by two slits, the number of slits is not limited. Therefore, the finger hook 30 may be formed by one slit or three or more slits.

Further, the finger hook 30 can be disposed in the handle portion 20 while being surrounded by a heat seal (not illustrated). The heat seal can be formed by heat sealing as in the case of forming the handle portion 20. The finger hook 30 can be disposed inside the heat seal and apart from the heat seal.

In addition, the handle portion 20 may be provided with a reinforcing film (not illustrated) that reinforces a portion of the handle portion 20 where the finger hook 30 is provided. A mode of such a reinforcing film is arbitrary. However, it is preferable that the reinforcing film is attached to the handle portion 20 by heat sealing (heat seal) as in the case of forming the handle portion 20. In addition, the reinforcing film can be formed of a belt-shaped resin film. A material of the reinforcing film may be the same as or different from the material of the resin film forming the handle portion 20. A thickness dimension of the reinforcing film is arbitrary. For example, from a viewpoint of preventing the handle portion 20 from extending or breaking, the thickness is preferably set to 20 μm or more.

As illustrated in FIGS. 1 to 3, the sheet package 100 according to the first embodiment includes a sheet roll SR in which a sheet ST is wound in a circumferential direction of a cylindrical core PT, and the packaging bag FB in which the sheet roll SR is stored. Here, the sheet ST is an example of a sheet forming a part of a sheet roll in the sheet package of the invention. In addition, the cylindrical core PT is an example of a cylindrical core included in a part of the sheet roll in the sheet package of the invention.

The dimensions of the sheet roll SR stored in the main body 10 of the packaging bag FB are not particularly limited. However, in a state of being stored in the packaging bag FB, a height (roll width) in the vertical direction (Z direction) is preferably about 85 mm to 300 mm, and a width (roll diameter) in the lateral direction (X direction) is preferably about 80 mm to 120 mm.

In addition, a form of the sheet roll SR is not limited to the roll shape form as long as the sheet roll SR has a cylindrical core. Further, the use of the sheet roll SR stored in the packaging bag FB is not particularly limited, and the sheet roll SR can be used for toilet paper, kitchen paper, tissue paper, paper towel, etc.

In addition, the number of sheet rolls SR stored in the packaging bag FB is not particularly limited, and may be one or two or more. In the first embodiment, a total of eight pieces of roll-shaped toilet paper are accommodated in a state in which four pieces are arranged in one stage and two stages are stacked (see FIG. 1). Note that arrangement of the sheet rolls SR stored in the main body 10 of the packaging bag FB is not limited to this arrangement. For example, four pieces of roll-shaped kitchen paper (kitchen rolls) arranged in one stage, or five or more pieces of roll-shaped toilet paper (toilet rolls) arranged in one stage may be stored in the main body 10 of the packaging bag FB.

The sheet ST is not particularly limited. For example, it is possible to use crepe paper included in sanitary thin paper. The crepe paper is paper in which fine wrinkles are formed on a surface by applying a blade referred to as a doctor blade at an exit of a dryer of a paper machine in a papermaking process.

As the crepe paper included in the sheet ST, paper whose raw material for base paper is pulp is used. As a pulp composition, it is possible to use a known composition for sanitary thin paper such as toilet paper and kitchen paper. For example, a mixing ratio of pulp can be set to 50% by mass or more, preferably 90% by mass or more, and more preferably 100% by mass.

In addition, as a pulp composition in crepe paper, for example, it is possible to use softwood pulp such as NBKP (softwood kraft pulp) or NUKP (unbleached softwood pulp), and hardwood pulp such as LBKP (hardwood kraft pulp) or LUKP (unbleached hardwood pulp) at an appropriate ratio. A ratio of softwood pulp to hardwood pulp is preferably 20:80 to 80:20.

A basis weight of the crepe paper is not particularly limited. For example, it is possible to adopt a basis weight (or grams per square meter) measured according to JIS P 8124 (1998). For example, the basis weight of the crepe paper included in the sheet ST is preferably 10.0 to 50.0 $g/m^2$, and more preferably 12.0 to 40.0 $g/m^2$ per ply.

In addition, a paper thickness of the crepe paper is not particularly limited. For example, it is possible to adopt the paper thickness measured under the environment of JIS P 8111 (1998). For example, the paper thickness of the crepe paper included in the sheet ST is preferably 50 to 500 μm, and more preferably 60 to 330 μm per ply.

Note that in a method for measuring the paper thickness, after the humidity of the test piece is sufficiently adjusted under the condition of JIS P 8111 (1998), measurement is performed in a 2-ply state using a dial thickness gauge (thickness measuring instrument) "PEACOCK G type" (made by OZAKI MFG. Colo., LTD.) under the same condition. Specifically, after confirming that there is no dirt or dust between a plunger and a measuring table, the plunger is placed on the measuring table and a memory of the dial thickness gauge is moved to adjust a zero point. Then, the plunger is raised to place the sample on a testing bench, and the gauge is read when the plunger is slowly lowered. In this instance, the plunger is merely used for placing. A terminal of the plunger is made of metal, and a circular plane having a diameter of 10 mm hits a plane of the paper perpendicularly. In addition, a load at the time of measuring the paper thickness is about 70 gf. The paper thickness is an average value obtained by performing the measurement 10 times.

In addition, the crepe paper included in the sheet ST may be embossed in the one-ply state. In such embossing, a convex embossing roll (not illustrated) is pressed against the crepe paper by a known steel rubber type embossing method to form a convex embossing on one surface of the crepe paper. In addition, a concave embossing corresponding to the convex embossing is formed on the other surface of the crepe paper.

Note that a shape of a top of the convex embossing (or an opening of the concave embossing corresponding to the convex embossing) formed on the crepe paper is not particularly limited. For example, it is possible to adopt a shape such as a quadrangular shape, a triangular shape, or a circular shape in plan view. In addition, a side surface of the convex embossing is preferably tapered (not illustrated) from the surface of the crepe paper where the convex embossing is not formed to the top of the convex embossing. When the convex embossing having such a tapered side surface is provided, the sheet ST is hardly crushed in the thickness direction.

The number of plies of the sheet ST is not particularly limited, and can be set to 1 ply or more, and preferably 1 ply (single ply) or 2 plies (two ply). A form of the sheet ST is not particularly limited. For example, it is preferable that perforations for cutting are formed at predetermined intervals on a long (or band-shaped) sanitary thin paper. In the first embodiment, the sheet ST is formed of one ply (two sheets are stacked) of the crepe paper on which the above-mentioned convex embossing is formed.

Specifically, the sheet ST has a stacked structure in which two sheets of crepe paper having a convex embossing are stacked and integrated. A form of such a stacked structure is not particularly limited, and a tip-to-tip type stacked structure, a nested type stacked structure, etc., which is adopted in a conventional stacked structure of sanitary thin paper, can be adopted.

Further, such a stacked structure can be formed by attaching two pieces of crepe paper using an adhesive. As such an adhesive, it is possible to use a known adhesive used for sanitary thin paper having a stacked structure. Examples of such an adhesive include polyvinyl alcohol, starch, modified starch, and a cellulosic adhesive such as carboxymethyl cellulose.

The cylindrical core PT is not particularly limited as long as the sheet ST can be wound in the circumferential direction. For example, a cylindrical winding core can be used. In addition, a material of the cylindrical core PT is not particularly limited, and paper, resin, etc. can be used. Note that when the sheet ST is sanitary thin paper such as toilet paper or kitchen paper, it is preferable to use a cylindrical cardboard winding core (also referred to as a paper tube).

In the first embodiment, as illustrated in FIGS. 1 to 3, in the sheet roll SR, at least one end surface EF in the roll width direction (Z direction) faces the top surface 11 of the main body 10 of the packaging bag FB. In addition, the cylindrical core PT has an opening OP in which an end edge TE on the one end surface EF side of the sheet roll SR is open. Here, the opening OP of the cylindrical core PT communicates with a space inside the cylindrical core PT. In addition, the opening OP of the cylindrical core PT includes the end edge TE of the cylindrical core PT.

Further, a first slit 40 overlapping the opening OP of the cylindrical core PT is formed on the top surface 11 of the packaging bag FB (main body 10). Note that a shape of the first slit 40 is arbitrary and can be formed by, for example, a notch such as a perforation. In the present embodiment, the first slit 40 is formed by a perforation, and a notch is formed by breaking the perforation. Note that in the first embodiment, as illustrated in FIGS. 1 to 3, the perforations forming the first slit 40 are indicated by a broken line. In addition, the shape of the first slit 40 is not particularly limited, and may be a shape such as a straight line, a curved line, a triangle, a quadrangle, or a circle.

In addition, the perforation of the first embodiment can be formed by any tie and cut. In the present embodiment, the tie is preferably 1.0 to 8.0 mm, more preferably 1.5 to 6.0 mm, and further preferably 2.0 to 4.0 mm. The cut is preferably 0.3 to 3.0 mm, more preferably 0.5 to 2.5 mm, and further preferably 1.0 to 2.0 mm.

In addition, in the first embodiment, at least a part of the first slit 40 overlaps the center part OC of the opening OP (see FIGS. 1 and 3). Here, the center part OC of the opening OP indicates a central region of the opening OP including a center of the opening OP. In the first embodiment, the first slit 40 is disposed on the top surface 11 so that a part 40*a* of the first slit 40 overlaps the center part OC of the opening OP.

In addition, in the first embodiment, the first slit 40 includes one linear slit. Here, the linear slit indicates that a shape of the slit is linear. Note that a form of the linear slit is not particularly limited, and it is possible to adopt a shape of a line such as a straight line or a curved line. In the first embodiment, the linear slit is formed in a shape of a straight line.

FIGS. 4 to 7 are diagrams illustrating usage states of the sheet package 100 according to the first embodiment. Here, the effect of the present embodiment will be described with reference to FIGS. 4 to 7. In the first embodiment, as described above, in the sheet package 100, at least one end surface EF of the sheet roll SR in the roll width direction (Z direction) faces the top surface 11 of the main body 10 of the packaging bag FB. In addition, the cylindrical core PT has the opening OP in which the end edge TE of the cylindrical core PT on the one end surface EF side of the sheet roll SR is opened. Further, the first slit 40 overlapping the opening OP of the cylindrical core PT is formed on the top surface 11 of the main body 10 of the packaging bag FB.

In the first embodiment, the first slit 40 formed on the top surface 11 of the main body 10 of the packaging bag FB overlaps the opening OP communicating with the space inside the cylindrical core PT. In this way, a portion of the top surface 11 of the main body 10 of the packaging bag FB where the first slit 40 is formed is easily bent with respect to the opening OP of the cylindrical core PT. For this reason, when the packaging bag FB is opened by breaking the first slit 40 with a finger F, the finger F is easily caught in the first slit 40, and the packaging bag FB is easily opened (see FIGS. 4 and 5).

In addition, in the first embodiment, since the finger F caught in the first slit 40 is inserted into the space inside the cylindrical core PT from the opening OP of the cylindrical core PT, the finger F does not directly comes into contact with the sheet roll SR. For this reason, when the finger F is applied to the first slit 40 to break the first slit 40, it is possible to prevent the finger F from hitting the sheet roll SR and damaging the sheet ST (see FIG. 4).

In addition, in the first embodiment, by pressing the finger F from the first slit 40 toward the opening OP of the cylindrical core PT, the first slit 40 is easily broken and the finger F is inserted into the space inside the cylindrical core PT. For this reason, in the first embodiment, the packaging bag FB can be opened with a small force.

In addition, in the first embodiment, since the packaging bag FB can be opened with a small force, a size of an opening hole formed in the packaging bag FB can be easily adjusted. For this reason, the size of the opening hole of the packaging bag FB can be adjusted so that the sheet roll SR can be easily taken out.

In addition, in the first embodiment, since the size of the opening hole of the packaging bag FB can be easily adjusted, the size of the opening hole of the packaging bag FB can be reduced. For this reason, even after opening the packaging bag FB, the remaining sheet rolls SR after taking out some of the sheet rolls SR can be protected from dirt and dust (dirt, dust, mote, etc.) (see FIGS. 6 and 7). As described above, the sheet package 100 according to the first embodiment is excellent in the openability, the take-out property, and the storability after opening.

In addition, in the first embodiment, since the part 40*a* of the first slit 40 overlaps the center part OC of the opening OP, the first slit 40 is disposed on the top surface 11 so as to overlap the center part OC of the opening OP of the cylindrical core PT at all times. In this way, in the first embodiment, the finger F is easily caught in the first slit 40 when the packaging bag FB is opened, and the first slit 40 is easily broken. For this reason, according to the first embodiment, the openability of the sheet package 100 can be improved.

In addition, in the first embodiment, since the first slit 40 includes at least one linear slit, it is easy to form the first slit 40. In addition, in the first embodiment, since the first slit 40 includes such a linear slit, at least one end portion of the first slit 40 can be extended toward the first side surface 13 or the second side surface 14 side continuous with the top surface 11 of the packaging bag FB (main body 10).

Specifically, the end portion 40*b* or both the end portion 40*b* and the end portion 40*c* of the first slit 40 extend toward the one side surface 13*a* side of the packaging bag FB (main body 10). In this way, in the first embodiment, after the first slit 40 is broken, the direction in which the packaging bag FB is broken easily advances from the top surface 11 of the main body 10 toward the first side surface 13 (one side surface 13*a*). For this reason, in the first embodiment, since the packaging bag FB can be easily opened from the top surface 11 of the main body 10 toward the first side surface 13, the sheet roll SR can be easily taken out (see FIGS. 1, 3, 6, and 7).

FIG. 8 is a diagram in which a side surface of an embodiment (second embodiment) of the invention is unfolded so as to be flush with a top surface of a packaging bag. FIG. 9 is a diagram illustrating an embodiment (third embodiment) of the invention. As illustrated in FIGS. 8 and 9, in the second embodiment and the third embodiment, in the first slit 40, at least two end portions 40*b* and 40*c* of the linear slits included in the first slit 40 extend toward the same side surface (one side surface 13*a*) of the side surfaces (the first side surface 13 and the second side surface 14) of the packaging bag FB.

Specifically, in the second embodiment, as illustrated in FIG. 8, the first slit 40 includes one U-shaped linear slit. By adopting such a U-shaped linear slit, the first slit 40 can extend a direction extending from the part 40*a* of the first slit 40 overlapping the center part OC of the opening OP of the cylindrical core PT to the end portion 40*b* and a direction extending to the end portion 40*c* toward the same side surface (one side surface 13*a*) of the packaging bag FB.

In addition, in the third embodiment, as illustrated in FIG. 9, a configuration is adopted in which three straight line-shaped linear slits radially extend from the part 40*a* of the first slit 40 overlapping the center part OC of the opening OP. According to this configuration, in the third embodiment, the direction extending from the part 40*a* of the first slit 40 to the end portion 40*b*, the direction extending to the end portion 40*c*, and further a direction extending to an end portion 40*d* are different from one another. Of these directions, the direction extending from the part 40*a* of the first slit 40 to the end portion 40*b* and the direction extending to the end portion 40*c* extend toward the same side surface (one side surface 13*a*) of the packaging bag FB.

In this way, in the second embodiment and third embodiment, the direction in which the first slit 40 is broken is dispersed in at least two directions, so that the first slit 40 is easily broken.

Moreover, in the second embodiment and third embodiment, when the first slit 40 is broken in two directions toward the same side surface (one side surface 13*a*) of the packaging bag FB from the two end portions 40*b* and 40*c* of the linear slit included in the first slit 40, a broken piece corresponding to the opening hole of the packaging bag FB is formed. This broken piece is included in a part of the packaging bag formed (or turned up) by breaking the first slit 40. By pinching the broken piece, it becomes easier to open the sheet package. For this reason, according to the second embodiment and the third embodiment, the openability of the sheet package 100 can be improved.

FIG. 10 is a diagram illustrating an embodiment (fourth embodiment) of the invention. In the sheet package 100 of the fourth embodiment, as illustrated in FIG. 10, the first slit 40 has a base portion 41 overlapping the opening OP, and extensions 42 (42*a* and 42*b*) which are continuous with the base portion 41 and overlap a part EP of the end surface EF of the sheet roll SR near the end edge TE of the cylindrical core PT.

In the fourth embodiment, since the base portion 41 of the first slit 40 overlaps the opening OP, it is possible to open the packaging bag FB through the base portion 41. In addition, since the extensions 42 (42*a* and 42*b*) of the first slit 40 are continuous with the base portion 41 and overlap the part EP of the end surface EF of the sheet roll SR near the end edge TE of the cylindrical core PT, the packaging bag FB can be further opened through the extensions 42 (42*a* and 42*b*) after the base portion 41 is broken. In this way, after the first slit 40 is broken, the packaging bag FB can be broken in a direction away from the first slit 40. For this reason, in the fourth embodiment, it becomes easier to open the packaging bag FB.

In addition, in the fourth embodiment, from a different point of view, when the first slit 40 does not completely overlap the inner part of the opening OP, the base portion 41 of the first slit 40 becomes a portion overlapping the opening OP, and the extensions 42 (42*a* and 42*b*) of the first slit 40 may become portions not overlapping the opening OP (portions overlapping the part EP of the end surface EF of the sheet roll SR near the end edge TE of the cylindrical core PT). For this reason, even when a position of the first slit 40 formed on the top surface 11 of the main body 10 of the packaging bag FB is slightly shifted with respect to the opening OP, the excellent openability of the packaging bag FB can be maintained.

FIG. 11 is a diagram illustrating an embodiment (fifth embodiment) of the invention. In addition, FIG. 12 is a diagram illustrating an embodiment (sixth embodiment) of the invention. In the fifth embodiment and the sixth embodiment, as illustrated in FIGS. 11 and 12, on the top surface 11 and the first side surface 13 (one side surface 13*a*) of the main body 10 of the packaging bag FB, a second slit 50 (51 and 52) is formed continuously from the first slit 40 to extend from the top surface 11 of the main body 10 to the first side surface 13 (one side surface 13*a*).

In the fifth embodiment, since the second slit 50 continuous with the first slit 40 is formed on the top surface 11 and the first side surface 13 (one side surface 13*a*) of the main body 10 of the packaging bag FB, a direction in which the packaging bag FB is opened is easily directed to the second slit 50 after the first slit 40 is broken. In this way, in the fifth embodiment, the packaging bag FB can be easily opened from the top surface 11 of the main body 10 of the packaging bag FB to the first side surface 13 (one side surface 13*a*).

In addition, in the sixth embodiment, the second slit 50 continuous with the first slit 40 includes two second slits 50 (51 and 52) continuous with the end portion 40*b* and the end portion 40*c* of the two linear slits. In the sixth embodiment, since the two second slits 50 (51 and 52) are formed on the top surface 11 and the first side surface 13 (one side surface 13*a*) of the main body 10 of the packaging bag FB, the direction in which the packaging bag FB is opened is easily directed to the two second slits 50 (51 and 52) after the first slit 40 is broken. In this way, in the sixth embodiment, the packaging bag FB can be more easily opened from the top surface 11 of the main body 10 of the packaging bag FB to the first side surface 13 (one side surface 13*a*).

EXAMPLES

Hereinafter, the invention will be specifically described with reference to examples. Evaluation of the examples and comparative examples was performed by the following tests.

[Sheet Package (Test Body)

As a test body, the sheet package 100 in which the sheet roll SR was stored in the packaging bag FB was prepared. For the sheet roll SR, eight pieces of roll-shaped toilet paper ("Elleair toilet tissue 60 m single (147 g/roll)" manufactured by Daio Paper Co., Ltd.) were used. Referring to the dimensions of the toilet paper, in a state of being stored in the sheet package 100, a height (roll width) in the vertical direction (Z direction) is about 114 mm, and a width (roll diameter) in the later direction (X direction) is about 106 mm. The eight sheet rolls SR were stored such that four sheets were arranged side by side in one stage and two stages were stacked. In addition, the packaging bag FB was produced by folding a 25 μm-thick polyethylene (PE) film in a cylindrical shape into a gusset shape using a bag-making machine.

[Opening Resistance Test]

An opening resistance test was conducted on the sheet package 100. The test was performed using a push-pull gauge (made by Imada, model number: Z2-20) with a flat standard attachment (A-2) and an extension rod (A-6). A slit formed in the packaging bag FB was pushed in the vertical direction, a value until the film was broken was read, and an opening resistance value (kgf) was measured. Note that when there was no slit, the film was pushed from a center part of a paper tube until the film broke, and an opening resistance value was measured. The test was performed 5 times for each of the examples and comparative examples, and an average value was calculated. Further, in Reference Example 1, since the sheet roll SR interfered and opening was not allowed, measurement was regarded as impossible (-). In evaluation of the opening resistance test, the opening resistance was evaluated as excellent when the opening resistance value was less than 2.00 kgf, and evaluated as not excellent (poor) when the opening resistance value was 2.00 kgf or more.

[Openability]

The ease of opening (openability) at the time of opening by a user using one hand along the slit formed in the packaging bag FB of the sheet package 100 (at the time of freeing opening when the slit was not formed) was evaluated. The test was performed 5 times for each of the examples and comparative examples, and evaluation was performed according to the following criterion.

○: Opening using one hand was allowed 5 times out of 5 times (excellent)

X: Opening using one hand was not allowed even once in 5 times (poor)

[Take-Out Property]

The easiness of taking out (take-out property) when one sheet roll SR in the sheet package 100 was taken out after the sheet package 100 was opened was evaluated. The take-out property was evaluated according to the following criterion from an average value of results of tests conducted by five users and scored for each of the examples and the comparative examples. The take-out property was evaluated excellent when the average value was 3.5 points or more.

5 points: significantly easy to take out 4 points: easy to take out 3 points: no opinion 2 points: difficult to take out 1 point: significantly difficult to take out

[Storability]

After taking out one sheet roll SR in the opened sheet package 100, it was verified whether or not the sheet roll SR remaining in the sheet package 100 can be wrapped in the opened packaging bag FB, and the storability after opening was evaluated. The test was performed 5 times for each of the examples and comparative examples, and evaluation was performed according to the following criterion.

○: Wrapping was allowed 5 times out of 5 times (excellent)

X: Wrapping was not allowed once or more in 5 times (poor)

Example 1

The sheet package 100 of the first embodiment illustrated in FIGS. 1 and 3 was produced. In the sheet package 100, the first slit 40 overlapping the opening OP of the cylindrical core PT was formed on the top surface 11 of the main body 10 of the packaging bag FB. In addition, the first slit 40 includes one linear slit, and the first slit 40 has a linear shape. For the sheet package 100, the openability, the take-out property, and the storability were evaluated. The results are shown in Table 1.

Example 2

The sheet package 100 of the second embodiment illustrated in FIG. 8 was produced. In the sheet package 100, except that the shape of the first slit 40 is set to a U-shape, and the direction extending from the part 40*a* of the first slit 40 to the end portion 40*b* and the direction extending to the end portion 40*c* are directed to the same side surface (one side surface 13*a*), the sheet package 100 was produced and evaluated similarly to Example 1. The results are shown in Table 1.

Example 3

The sheet package 100 of the third embodiment illustrated in FIG. 9 was produced. In the sheet package 100, except that the shape of the first slit 40 is set to a shape in which three straight line-shaped linear slits extend radially from the part 40*a* of the first slit 40, and the direction extending from the part 40*a* of the first slit 40 to the end portion 40*b*, the direction extending to the end portion 40*c*, and the direction extending to the end portion 40*d* are different from one another, the sheet package 100 was produced and evaluated similarly to Example 1. The results are shown in Table 1.

Example 4

The sheet package 100 of the fourth embodiment illustrated in FIG. 10 was prepared. In the sheet package 100, except that the base portion 41 overlapping the opening OP and the extension 42 (42*a* and 42*b*) which is continuous with the base portion 41 and overlaps the part EP of the end surface EF of the sheet roll SR near the end edge TE of the cylindrical core PT (not overlapping the opening OP) are provided in the first slit 40, the sheet package 100 was produced and evaluated similarly to Example 2. The results are shown in Table 1.

Example 5

The sheet package 100 of the fifth embodiment illustrated in FIG. 11 was prepared. In the sheet package 100, except that the second slit 50 (51 and 52) which is continuous with the first slit 40 (end portion 40*b*) and extends from the top surface 11 of the main body 10 to the first side surface 13 (one side surface 13*a*) is provided on the top surface 11 and the first side surface 13 (one side surface 13*a*) of the main body 10 of the packaging bag FB, the sheet package 100 was produced and evaluated similarly to Example 1. The results are shown in Table 1.

Example 6

The sheet package 100 of the sixth embodiment illustrated in FIG. 12 was prepared. In the sheet package 100, except that the second slit 50 (51 and 52) which is continuous with the first slit 40 (the end portion 40*b* and the end portion 40*c*) and extends from the top surface 11 to the first side surface 13 (one side surface 13*a*) is provided on the top surface 11 and the first side surface 13 (one side surface 13*a*) of the main body 10 of the packaging bag FB, the sheet package 100 was produced and evaluated similarly to Example 3. The results are shown in Table 1.

Comparative Example 1

A sheet package 100 illustrated in FIG. 13 was prepared. In the sheet package 100, except that the first slit 40 was not provided, the sheet package 100 was produced and evaluated similarly to Example 1. The results are shown in Table 1.

Comparative Example 2

A sheet package 100 illustrated in FIG. 14 was prepared. In the sheet package 100, except that a straight line-shaped slit 60 not overlapping the opening OP of the cylindrical core PT was formed on the first side surface 13 (one side surface 13*a*) of the main body 10 of the packaging bag FB, the sheet package 100 was produced and evaluated similarly to Example 1. The results are shown in Table 1.

Reference Example 1

A sheet package 100 illustrated in FIG. 15 was prepared. In the sheet package 100, except that a straight line-shaped slit 60 not overlapping the opening OP of the cylindrical core PT was formed from the top surface 11 of the main body 10 of the packaging bag FB to the first side surface 13 (one side surface 13*a*), the sheet package 100 was produced and evaluated similarly to Example 1. The results are shown in Table 1.

TABLE 1

| | Example 1 | Example 2 | Example 3 | Example 4 | Example 5 | Example 6 | Comparative Example 1 | Comparative Example 2 | Reference Example 1 |
|---|---|---|---|---|---|---|---|---|---|
| Opening resistance test (kgf) | 1.14 | 1.19 | 0.92 | 1.25 | 1.09 | 0.89 | 2.73 | 2.28 | — |
| Openability | ○ | ○ | ○ | ○ | ○ | ○ | X | X | X |
| Take-out property | 4.0 | 4.4 | 4.2 | 4.2 | 4.2 | 4.4 | 2.0 | 3.2 | 3.4 |
| Storability | ○ | ○ | ○ | ○ | ○ | ○ | X | ○ | ○ |

From Table 1, in all the sheet packages 100 in which the first slit 40 overlapping the opening OP of the cylindrical core PT was formed on the top surface 11 of the main body 10 of the packaging bag FB, the opening resistance value was less than 2.00 kgf (excellent), the openability was ○ (excellent), the take-out property was 3.5 or more (excellent), and the storability was ○ (excellent) (Examples 1 to 6).

On the other hand, in any of the sheet packages 100 in which the first slit 40 overlapping the opening OP of the cylindrical core PT was not provided on the top surface 11 of the main body 10 of the packaging bag FB, the opening resistance value was 2.00 kgf or more (poor), the openability was X (poor), the take-out property was less than 3.5 (poor), and the storability was X (poor) (Comparative Examples 1 and 2, and Reference Example 1). Note that in Reference Example 1, in the opening resistance test, the sheet roll SR interfered, and opening was not allowed (measurement not allowed).

From these results, it was found that by forming the first slit overlapping the opening of the cylindrical core on the top surface of the packaging bag, it is possible to obtain the sheet package excellent in the openability, the take-out property, and the storability.

Even though the embodiments of the invention have been described above, the invention is not limited to the specific embodiments, and various modifications and changes are possible within the scope of the invention described in the claims.

Hereinafter, preferred aspects of the invention will be additionally described.

A first aspect of the invention provides a sheet package including a sheet roll in which a sheet is wound in a circumferential direction of a cylindrical core, and a packaging bag in which the sheet roll is stored, in which at least one end surface of the sheet roll in a roll width direction faces a top surface of the packaging bag, the cylindrical core has an opening in which an end edge of the sheet roll on a side of the one end surface is open, and a first slit overlapping the opening of the cylindrical core is formed on the top surface.

In the first aspect, in the sheet package, at least one end surface of the sheet roll in the roll width direction faces the top surface of the packaging bag. In addition, the cylindrical core has the opening in which the end edge of the sheet roll on the side of the one end surface is open. Further, the first slit overlapping the opening of the cylindrical core is formed on the top surface of the packaging bag. Note that the opening of the cylindrical core communicates with a space in the cylindrical core. In addition, the opening of the cylindrical core includes an end edge of the cylindrical core.

In the first aspect, since the first slit formed on the top surface of the packaging bag overlaps such an opening that communicates with the space in the cylindrical core, a portion where the first slit is formed on the top surface of the packaging bag is easily bent with respect to the opening of the cylindrical core. In this way, in the first aspect, when the packaging bag is opened, a finger is easily caught in the first slit, and thus it is easy to open the packaging bag.

In addition, in the first aspect, since the finger caught in the first slit is inserted into the space inside the cylindrical core from the opening of the cylindrical core, the finger does not directly come into contact with the sheet roll. For this reason, when the finger is applied to the first slit to break the first slit, it is possible to prevent the finger from hitting the sheet roll and damaging the sheet.

In addition, in the first aspect, by pressing the finger from the first slit toward the opening of the cylindrical core, the finger is inserted from the first slit into the space inside the cylindrical core, and the first slit can be easily broken. For this reason, in the first aspect, the packaging bag can be opened with a small force.

In addition, in the first aspect, since the packaging bag can be opened with a small force, the size of the opening hole formed in the packaging bag can be easily adjusted. For this reason, the size of the opening hole of the packaging bag can be adjusted to a size at which the sheet roll can easily take out.

In addition, in the first aspect, since it is easy to adjust the size of the opening hole of the packaging bag, it is possible to reduce the size of the opening hole of the packaging bag when the packaging bag is opened. For this reason, even after opening the packaging bag, remaining sheet rolls after taking out sheet rolls can be protected from dirt and dust (dirt, dust, mote, etc.). Therefore, according to the first aspect, it is possible to provide the sheet package excellent in the openability, the take-out property, and the storability after opening.

A second aspect according to the invention provides the package in which at least a part of the first slit overlaps a center part of the opening. In this specification, the center part of the opening refers to a central region of the opening including a center of the opening. In addition, at least a part of the first slit refers to the whole or a part of the first slit overlapping the center part of the opening.

In the second aspect, since at least a part of the first slit overlaps the center part of the opening, the first slit is disposed on the top surface so as to overlap the center part of the opening of the cylindrical core at all times. For this reason, in the second aspect, when the packaging bag is opened, the finger is easily caught in the first slit and the first slit is easily broken. For this reason, according to the second aspect, the openability of the sheet package can be improved.

A third aspect according to the invention provides the sheet package in which the first slit includes at least one linear slit. In this specification, at least one slit means that the first slit includes one or a plurality of slits. In addition, the linear slit means that the shape of the slit is linear. In the third aspect, by configuring the first slit as such a linear slit, it is easy to form the first slit.

In addition, in the third aspect, since the first slit is such a linear slit, at least one end portion of the slit can be extended toward the side surface side of the packaging bag that is continuous with the top surface. For this reason, in the third aspect, after the first slit is broken, a direction in which the packaging bag is broken easily advances from the top surface to the side surface. In this way, in the third aspect, the packaging bag can be easily opened from the top surface to the side surface, and thus the sheet roll can be easily taken out.

A fourth aspect according to the invention provides the sheet package in which at least two end portions of the linear slit extend toward the same side surface of side surfaces of the packaging bag. In the fourth aspect, when at least two end portions of the linear slit included in the first slit extend toward the same side surface of the side surfaces of the packaging bag, the direction in which the first slit is broken is dispersed in at least two directions, and thus the first slit is easily broken.

In addition, in the fourth aspect, when the first slit is broken in at least two directions toward the same side surface of the packaging bag, a broken piece corresponding to the opening hole of the packaging bag (a part of the packaging bag formed (or turned up) by breaking the first slit) is formed. Then, by pinching the broken piece, it becomes easier to open the sheet package.

A fifth aspect according to the invention provides the sheet package in which the first slit has a base portion overlapping the opening, and an extension which is continuous with the base portion and overlaps a part of the end surface of the cylindrical core near the end edge. In the fifth aspect, since the base portion of the first slit overlaps the opening, it is possible to open the packaging bag through the base portion.

In addition, since the extension of the first slit is continuous with the base portion and overlaps a part of the end surface of the cylindrical core near the end edge, it is possible to further open the packaging bag through the extension after the base portion is broken. In this way, after the first slit is broken, the packaging bag can be broken in a direction away from the first slit. For this reason, it becomes easier to open the packaging bag.

In addition, from a different point of view, when the first slit does not completely overlap an inner part of the opening, the base portion of the first slit becomes a portion overlapping the opening, and the extension of the first slit may become a portion not overlapping the opening (portion overlapping a part of the end surface of the sheet roll near one end edge of the cylindrical core). For this reason, even when a position of the first slit formed on the top surface of the packaging bag is slightly shifted with respect to the opening, the excellent openability of the packaging bag can be maintained.

A sixth aspect according to the invention provides the sheet package in which a second slit which is continuous with the first slit and extends from the top surface of the packaging bag to a side surface of the packaging bag is formed. In the sixth aspect, since the second slit continuous with the first slit is formed on the top surface and the side surface of the packaging bag, the opening direction of the packaging bag tends to be directed to the second slit after the first slit is broken. For this reason, in the sixth aspect, the packaging bag can be easily opened from the top surface to the side surface of the packaging bag.

This application claims the priority based on Japanese Patent Application No. 2018-63601 filed on Mar. 29, 2018, and the entire contents thereof are incorporated herein.

The invention claimed is:

1. A sheet package comprising:

a sheet roll having a cylindrical core, in which a sheet is wound in a circumferential direction of the cylindrical core;

a packaging bag in which the sheet roll is stored, wherein at least one end surface of the sheet roll in a roll width direction faces a top surface of the packaging bag, the cylindrical core has an opening in which an end edge of the sheet roll on a side of the one end surface is open, and a first slit overlapping the opening of the cylindrical core is formed on the top surface, wherein the first slit is a continuous slit comprising a plurality of perforations, and the first slit has a first end portion overlapping the opening of the cylindrical core.

2. The sheet package according to claim 1, wherein at least a part of the first slit overlaps a center part of the opening.

3. The sheet package according to claim 2, wherein the first slit includes at least one linear slit.

4. The sheet package according to claim 1, wherein the first slit includes at least one linear slit.

5. The sheet package according to claim 1, wherein a length of the first slit is less than a diameter of the opening of the cylindrical core.

6. The sheet package according to claim 1, wherein the first slit has a second end overlapping the opening of the cylindrical core.

* * * * *